US010207895B2

(12) United States Patent
Lefevre et al.

(10) Patent No.: US 10,207,895 B2
(45) Date of Patent: Feb. 19, 2019

(54) ELEVATOR EMERGENCY POWER FEEDER BALANCING

(71) Applicants: Robert Henry Lefevre, Southington, CT (US); James M. Collins, Burlington, CT (US)

(72) Inventors: Robert Henry Lefevre, Southington, CT (US); James M. Collins, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 461 days.

(21) Appl. No.: 15/141,376

(22) Filed: Apr. 28, 2016

(65) Prior Publication Data

US 2017/0313547 A1 Nov. 2, 2017

(51) Int. Cl.

| | |
|---|---|
| ***B66B 1/06*** | (2006.01) |
| ***B66B 1/30*** | (2006.01) |
| ***B66B 1/34*** | (2006.01) |
| ***B66B 5/02*** | (2006.01) |

(52) U.S. Cl.

CPC ..... *B66B 1/30* (2013.01); *B66B 1/34* (2013.01); *B66B 5/021* (2013.01); *B66B 5/027* (2013.01)

(58) Field of Classification Search

CPC .. B66B 1/30; B66B 1/34; B66B 5/012; B66B 5/027

USPC ..... 187/247, 289, 290, 296, 297, 391, 393; 318/375, 376, 139; 307/66, 68

See application file for complete search history.

(56) References Cited

U.S. PATENT DOCUMENTS

| | | | |
|---|---|---|---|
| 3,506,095 | A | 4/1970 | Weaver |
| 4,379,499 | A | 4/1983 | Nowak |
| 5,896,948 | A | 4/1999 | Suur-Askola et al. |
| 6,938,733 | B2 | 9/2005 | Eilinger |
| 7,182,174 | B2 | 2/2007 | Parrini et al. |
| 7,246,686 | B2 | 7/2007 | Smith et al. |
| 7,464,793 | B2 | 12/2008 | Komatsu |
| 7,540,355 | B2 | 6/2009 | Harkonen |
| 7,554,278 | B2 * | 6/2009 | Wegner-Donnelly ..... B66C 13/18 187/277 |
| 7,588,126 | B2 | 9/2009 | Siikonen et al. |

(Continued)

FOREIGN PATENT DOCUMENTS

| | | | |
|---|---|---|---|
| CN | 101357725 | A | 2/2009 |
| CN | 102923537 | A | 2/2013 |

(Continued)

*Primary Examiner* — Anthony Salata

(74) *Attorney, Agent, or Firm* — Cantor Colburn LLP

(57) ABSTRACT

A system and method of balancing elevator car emergency power in an elevator system is provided. The method includes switching a first feeder group of elevator cars from building power provided through a first building power feeder to back-up power provided through a back-up power source, switching a second feeder group of elevator cars from the building power provided through a second building power feeder to the back-up power provided through the back-up power source, selecting, using an elevator controller, at least one elevator car from the first feeder group of elevator cars, selecting, using the elevator controller, at least one elevator car from the second feeder group of elevator cars, and powering the selected elevator cars from the first feeder group and the second feeder group using the back-up power from the back-up power source.

20 Claims, 8 Drawing Sheets

(56) References Cited

U.S. PATENT DOCUMENTS

| | | | | |
|---|---|---|---|---|
| 7,594,564 | B2 | 9/2009 | Siikonen et al. | |
| 7,681,694 | B2 | 3/2010 | Aulanko et al. | |
| 7,909,143 | B2 | 3/2011 | Tyni et al. | |
| 7,913,819 | B2 | 3/2011 | Siikonen et al. | |
| 7,967,113 | B2 | 6/2011 | Smith et al. | |
| 8,109,368 | B2 | 2/2012 | Manabe | |
| 8,172,042 | B2 | 5/2012 | Wesson et al. | |
| 8,220,590 | B2 * | 7/2012 | Chen | B66B 1/302 187/290 |
| 8,230,978 | B2 * | 7/2012 | Agirman | B66B 5/027 187/290 |
| 8,230,980 | B2 | 7/2012 | Mason | |
| 8,251,185 | B2 | 8/2012 | Manabe | |
| 8,631,908 | B2 | 1/2014 | Schroeder-Brumloop et al. | |
| 8,714,313 | B2 | 5/2014 | Harkonen et al. | |
| 8,839,914 | B2 * | 9/2014 | Iwata | B66B 5/024 187/384 |
| 8,960,371 | B2 | 2/2015 | Schoenauer et al. | |
| 9,440,819 | B2 * | 9/2016 | Rossignol | B66B 1/302 |
| 9,546,072 | B2 * | 1/2017 | Sonnenmoser | B66B 1/2408 |
| 9,834,406 | B2 * | 12/2017 | Mezzadri | B66B 1/306 |
| 9,914,617 | B2 * | 3/2018 | Horbrugger | B66B 1/302 |
| 2011/0120811 | A1 | 5/2011 | Kallioniemi et al. | |
| 2011/0139547 | A1 | 6/2011 | Veronesi et al. | |
| 2011/0144810 | A1 | 6/2011 | Wesson et al. | |
| 2012/0067673 | A1 | 3/2012 | Kallioniemi | |

FOREIGN PATENT DOCUMENTS

| | | | |
|---|---|---|---|
| CN | 103213885 | A | 7/2013 |
| CN | 104724555 | A | 6/2015 |
| EP | 0709332 | A1 | 5/1996 |
| JP | 2012188229 | A | 10/2012 |
| WO | 2010059139 | A1 | 5/2010 |

* cited by examiner

ELEVATOR EMERGENCY POWER FEEDER BALANCING

BACKGROUND

The subject matter disclosed herein generally relates to elevator emergency power and, more particularly, to balancing of elevator emergency power.

Currently, evacuation scenarios requiring use of elevators for evacuating large numbers of people from a building are lacking in power features and control. For example, typically an elevator controller selects which elevator cars to power based on a set priority list. For example, when an emergency occurs that requires that the elevators switch from building power to a back-up power generator, the controller will select a sub-set of elevator cars to power based on a priority list of all the elevator cars contained in all feeder groups connected to the power generator. However, depending on the emergency type and location within the building, this approach can lead to entire feeder groups being left without an operating elevator car for evacuation.

As such, additional control of elevators during an emergency when power is switched to back-up power is desired.

BRIEF DESCRIPTION

According to an embodiment, a method of balancing elevator car emergency power in an elevator system is provided. The method includes switching a first feeder group of elevator cars from building power provided through a first building power feeder to back-up power provided through a back-up power source, switching a second feeder group of elevator cars from the building power provided through a second building power feeder to the back-up power provided through the back-up power source, selecting, using an elevator controller, at least one elevator car from the first feeder group of elevator cars, selecting, using the elevator controller, at least one elevator car from the second feeder group of elevator cars, and powering the selected elevator cars from the first feeder group and the second feeder group using the back-up power from the back-up power source.

In addition to one or more of the features described above, or as an alternative, further embodiments may include wherein selecting, using the elevator controller, the at least one elevator car from the first feeder group of elevator cars, further includes selecting the at least one elevator car from the first feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

In addition to one or more of the features described above, or as an alternative, further embodiments may include, wherein selecting, using the elevator controller, the at least one elevator car from the second feeder group of elevator cars, further includes selecting the at least one elevator car from the second feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

In addition to one or more of the features described above, or as an alternative, further embodiments may include wherein switching the first feeder group of elevator cars further includes switching a first feeder switch from a first position that connects the first feeder group of elevator cars to the first building power feeder to a second position that connects the first feeder group of elevator cars to the back-up power source.

In addition to one or more of the features described above, or as an alternative, further embodiments may include, wherein switching the first feeder group of elevator cars further includes detecting an emergency condition, discontinuing the use of the building power by disconnecting from the first building power feeder in response to detecting the emergency condition, and commencing the use of the back-up power by connecting to the back-up power source in response to detecting the emergency condition.

In addition to one or more of the features described above, or as an alternative, further embodiments may include wherein the emergency condition is one selected from a group consisting of the building power from the first power feeder dropping below an operating threshold, a detection of a dangerous emergency condition within proximity of one or more elevators in the first feeder group, and a building management command noting the dangerous emergency condition.

In addition to one or more of the features described above, or as an alternative, further embodiments may include wherein switching the second feeder group of elevator cars further includes switching a second feeder switch from a first position that connects the second feeder group of elevator cars to the second building power feeder to a second position that connects the second feeder group of elevator cars to the back-up power source.

In addition to one or more of the features described above, or as an alternative, further embodiments may include wherein switching the second feeder group of elevator cars further includes detecting an emergency condition, discontinuing the use of the building power by disconnecting from the second building power feeder in response to detecting the emergency condition, and commencing the use of the back-up power by connecting to the back-up power source in response to detecting the emergency condition.

In addition to one or more of the features described above, or as an alternative, further embodiments may include wherein the emergency condition is one selected from a group consisting of the building power from the second power feeder dropping below an operating threshold, a detection of a dangerous emergency condition within proximity of one or more elevators in the second feeder group, and a building management command noting the dangerous emergency condition.

In addition to one or more of the features described above, or as an alternative, further embodiments may include wherein the first feeder group is a high rise elevator group, and wherein the second feeder group is a low rise elevator group.

In addition to one or more of the features described above, or as an alternative, further embodiments may include a plurality of feeder groups, wherein each of the plurality of feeder groups is switched from building power to the back-up power, and wherein, using the elevator controller, at least one elevator car is selected and powered from each feeder group in the plurality of feeder groups.

According to an embodiment a system for balancing elevator car emergency power is provided. The system includes a first feeder group of elevator cars configured to switch from building power provided through a first building power feeder to back-up power provided through a back-up power source, a second feeder group of elevator cars configured to switch from the building power provided through a second building power feeder to the back-up power provided through the back-up power source, and an elevator controller that selects at least one elevator car from the first feeder group of elevator cars and selects at least one elevator car from the second feeder group of elevator cars, wherein the back-up power source powers the selected elevator cars from the first feeder group and the second feeder group using the back-up power.

In addition to one or more of the features described above, or as an alternative, further embodiments may include wherein the first feeder group of elevator cars further includes a first feeder switch configured to switch from a first position that connects the first feeder group of elevator cars to the first building power feeder to a second position that connects the first feeder group of elevator cars to the back-up power source.

In addition to one or more of the features described above, or as an alternative, further embodiments may include wherein the second feeder group of elevator cars further includes a second feeder switch configured to switch from a first position that connects the second feeder group of elevator cars to the second building power feeder to a second position that connects the second feeder group of elevator cars to the back-up power source.

In addition to one or more of the features described above, or as an alternative, further embodiments may include wherein the first feeder group is a high rise elevator group, and wherein the second feeder group is a low rise elevator group.

In addition to one or more of the features described above, or as an alternative, further embodiments may include a plurality of feeder groups, wherein each of the plurality of feeder groups is switched from building power to the back-up power, and wherein, using the elevator controller, at least one elevator car is selected and powered from each feeder group in the plurality of feeder groups.

According to an embodiment, a computer program product for balancing elevator car emergency power is provided. The computer program product including a computer readable storage medium having program instructions embodied therewith, the program instructions executable by a processor to cause the processor to switch a first feeder group of elevator cars from building power provided through a first building power feeder to back-up power provided through a back-up power source, switch a second feeder group of elevator cars from the building power provided through a second building power feeder to the back-up power provided through the back-up power source, select, using an elevator controller, at least one elevator car from the first feeder group of elevator cars, select, using the elevator controller, at least one elevator car from the second feeder group of elevator cars, and power the selected elevator cars from the first feeder group and the second feeder group using the back-up power from the back-up power source.

In addition to one or more of the features described above, or as an alternative, further embodiments may include additional program instructions executable by the processor to cause the processor to select the at least one elevator car from the first feeder group of elevator cars based on one or more heuristics, and select the at least one elevator car from the second feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

In addition to one or more of the features described above, or as an alternative, further embodiments may include additional program instructions executable by the processor to cause the processor to switch a first feeder switch from a first position that connects the first feeder group of elevator cars to the first building power feeder to a second position that connects the first feeder group of elevator cars to the back-up power source, and switch a second feeder switch from a first position that connects the second feeder group of elevator cars to the second building power feeder to a second position that connects the second feeder group of elevator cars to the back-up power source.

In addition to one or more of the features described above, or as an alternative, further embodiments may include additional program instructions executable by the processor to cause the processor to detect an emergency condition, discontinue the use of the building power by disconnecting from the first building power feeder in response to detecting the emergency condition, discontinue the use of the building power by disconnecting from the second building power feeder in response to detecting the emergency condition, and commence the use of the back-up power by connecting to the back-up power source in response to detecting the emergency condition.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the present disclosure are apparent from the following detailed description taken in conjunction with the accompanying drawings in which.

DETAILED DESCRIPTION

Figure 1:
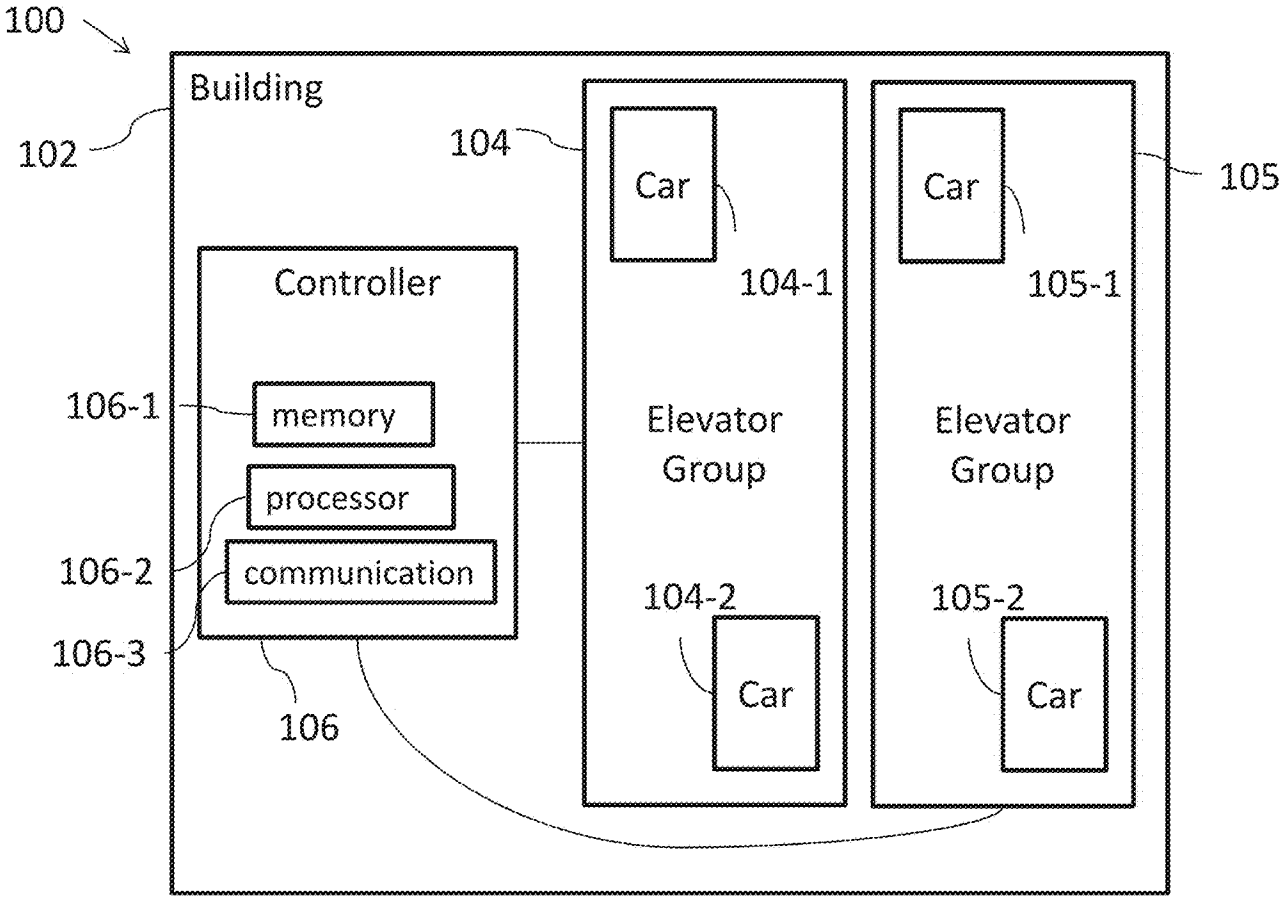
FIG. 1 depicts an elevator system in accordance with one or more embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Different elevator groups are typically energized with separate building power feeders. Often, two or more groups of elevators may be combined into a single group for dispatching purposes. When this occurs, the two or more separate elevator groups, which are normally powered by separate building power feeders, may be powered by a single emergency power source that is capable of running multiple cars. The emergency power source can be a generator, a solar panel, a wind turbine, a battery, an alternative feeder line, or any other known power means, and/or any combination thereof. A building owner may request that at least one car return to normal service in each separate feeder group, despite the cars being part of the same larger group.

One or more embodiments provide support for a 'feeder balancing' algorithm during elevator emergency power in which a minimum number of cars may be configured to run in each separate 'feeder group' during an emergency power situation. Further, according to one or more embodiments, the cars are returned to service within the scope of each separate 'feeder group' based upon a heuristic such as 'car that could serve maximum number of landings', 'most popular car in group', and/or 'configured priority list'.

Turning now to the figures, FIG. 1 depicts an elevator system 100 in accordance with one or more embodiments. The elevator system 100 is shown installed at a building 102. In some embodiments, the building 102 may be an office building or a collection of office buildings that may or may not be physically located near each other. The building 102 may include a number of floors. Persons entering the building 102 may enter at a lobby floor, or any other floor, and may go to a destination floor via one or more conveyance devices, such as an elevator group 104 and/or elevator group 105.

The elevator groups 104, 105 may be coupled to one or more computing devices, such as a controller 106. The controller 106 may be configured to control dispatching operations for one or more elevator cars (e.g., cars 104-1, 104-2, 105-1, 105-2) associated with the elevator groups 104 and 105, respectively. The elevator cars 104-1 and 104-2, and 105-1 and 105-2 may be located in one hoist way for each group 104, 105, respectively, or all in independent hoist ways so as to allow coordination amongst elevator cars in different elevator banks serving different floors. It is understood that other components of the elevator system 100 (e.g., drive, counterweight, safeties, etc.) are not depicted for ease of illustration.

The controller 106 may include a processor 106-2, a memory 106-1, and communication module 106-3 as shown in FIG. 1. The processor 106-2 can be any type or combination of computer processors, such as a microprocessor, microcontroller, digital signal processor, application specific integrated circuit, programmable logic device, and/or field programmable gate array. The memory 106-1 is an example of a non-transitory computer readable storage medium tangibly embodied in the controller 106 including executable instructions stored therein, for instance, as firmware. The communication module 106-3 may implement one or more communication protocols as described in further detail herein.

The elevator groups 104, 105 and the controller 106 communicate with one another. According to one or more embodiments, the communication between the elevator groups 104, 105 and the controller 106 is done through systems such as transmitters, converters, receivers, and other transmitting and processing elements depending on the communication type selected. The elevator groups 104, 105 and the controller 106 may communicate over a wireless network, such as 802.11x (WiFi), short-range radio (Bluetooth), or any other known type of wireless communication. In some embodiments, the controller 106 may include, or be associated with (e.g., communicatively coupled to) a networked element, such as kiosk, beacon, hall call fixture, lantern, bridge, router, network node, etc. The networked element may communicate with the elevator groups 104, 105 using one or more communication protocols or standards. For example, the networked element may communicate with the elevator groups 104, 105 using any type of known wired or wireless communication means. According to one or more other embodiments, the networked element may communicate with the elevator groups 104, 105 through a cellular network or over the internet through a number of other devices outside the building. Further, according to another embodiment, the controller 106 may be connected using a wired communication to each of the elevator groups 104, 105. For example, the wired communication may include a coaxial cable, a cat5, cat5e, cat6, power cable, or other cable capable of transmitting data to and from the controller 106 and elevator groups 104, 105.

According to one or more embodiments, the controller 106 may be located at a position within the building that is separate from either of the elevator groups 104, 105 as shown in FIG. 1. According to another embodiment, the controller 106 can be included within one of the elevator group 104, 105 or within one of the elevator cars 104-1, 104-2, 105-1, or 105-2. Further, according to another embodiment, the controller 106 may be located off-site outside of the building 102. Further, according to one or more embodiments, the controller 106 may be made up of a plurality of controllers that are located at any combination of locations. For example, a controller could be included in each elevator car as well as a master type controller within the building that communicates with the other controllers and together they determine processing decisions for controlling the elevator system.

Implementation of a method and system of balancing the powering of elevators in a plurality of elevator feeder groups using the elevator groups, controller, and overall elevator system is described with reference to FIGS. 2-6.

Figure 2A:
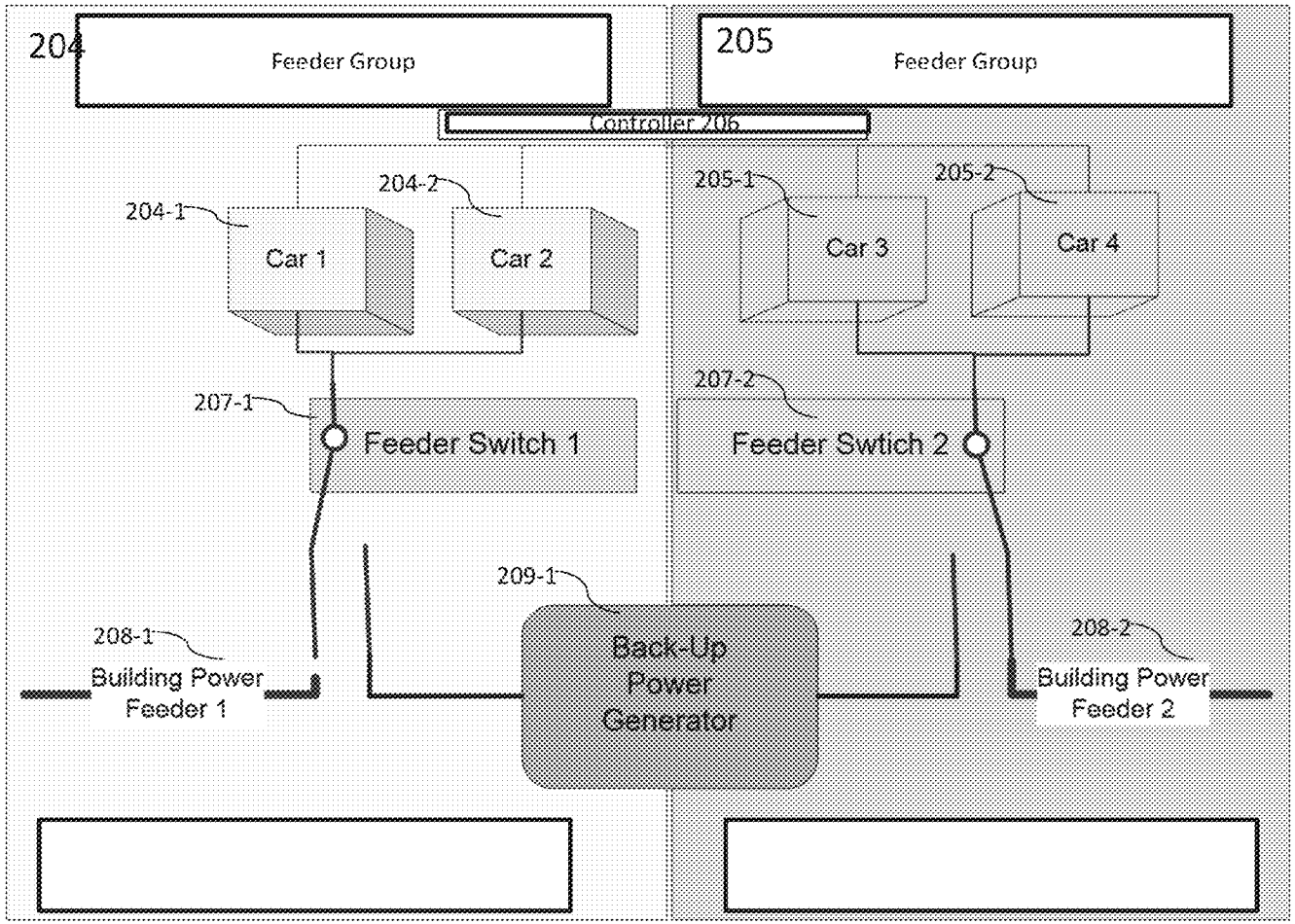
FIG. 2A depicts a system for balancing elevator car emergency power in an elevator system in accordance with one or more embodiments of the present disclosure.

FIG. 2A depicts a system 200A for balancing elevator car emergency power in an elevator system in accordance with one or more embodiments of the present disclosure. The system 200A is of a building that includes two elevator groups 204, 205. Specifically, the first elevator group is feeder group 204 and the second elevator group is a feeder group 205. The feeder group 204 includes elevator cars 204-1 and 204-2. The feeder group 204 and associated cars 204-1 and 204-2 are powered during normal operating conditions using building power that is provided from a building power feeder 208-1. In this embodiment, the building power is fed through a feeder switch 207-1. The switch 207-1 can switch the incoming power from the building power to back-up power that originates from a back-up power source 209-1. The back-up power source 209-1 can be a generator, a solar panel, a wind turbine, a battery, an alternative feeder line, or any other known power means, and/or any combination thereof. The feeder switch 207-1 would switch to back-up power source 209-1 during an emergency.

Similarly, feeder group 205 includes elevator cars 205-1 and 205-2. The feeder group 205 and associated cars 205-1 and 205-2 are powered during normal operating conditions using building power that is provided from a building power feeder 208-2. In this embodiment, the building power is fed through a feeder switch 207-2. The switch 207-2 can switch the incoming power from the building power to back-up power that originates from the back-up power source 209-1. The feeder switch 207-2 would switch to back-up power source 209-1 during an emergency.

Further, the system 200A includes a controller 206 that is communicatively connected to both feeder group 204 and feeder group 205 cars (204-1, 204-2, 205-1, and 205-2). The controller 206 can be used to facilitate dispatching during both normal and emergency power scenarios. For example, during an emergency power situation, feeder group 204 and feeder group 205 are both powered by the back-up power source 209-1. The back-up power source 209-1 may only be able to move a subset of elevator cars while providing basic power to all elevator cars. Accordingly selections need to be made by the controller 206 as to which cars will run. The controller 206 will always select at least one car from each feeder group. If additional power is available, the controller 206 can select additional cars to power and run to help evacuate additional users. For example, the controller 206 can select car 204-1 and car 205-1 to operate during the emergency condition. Alternatively, the controller 206 can select another combination of cars as long as there is one selected from each feeder group.

Figure 2B:
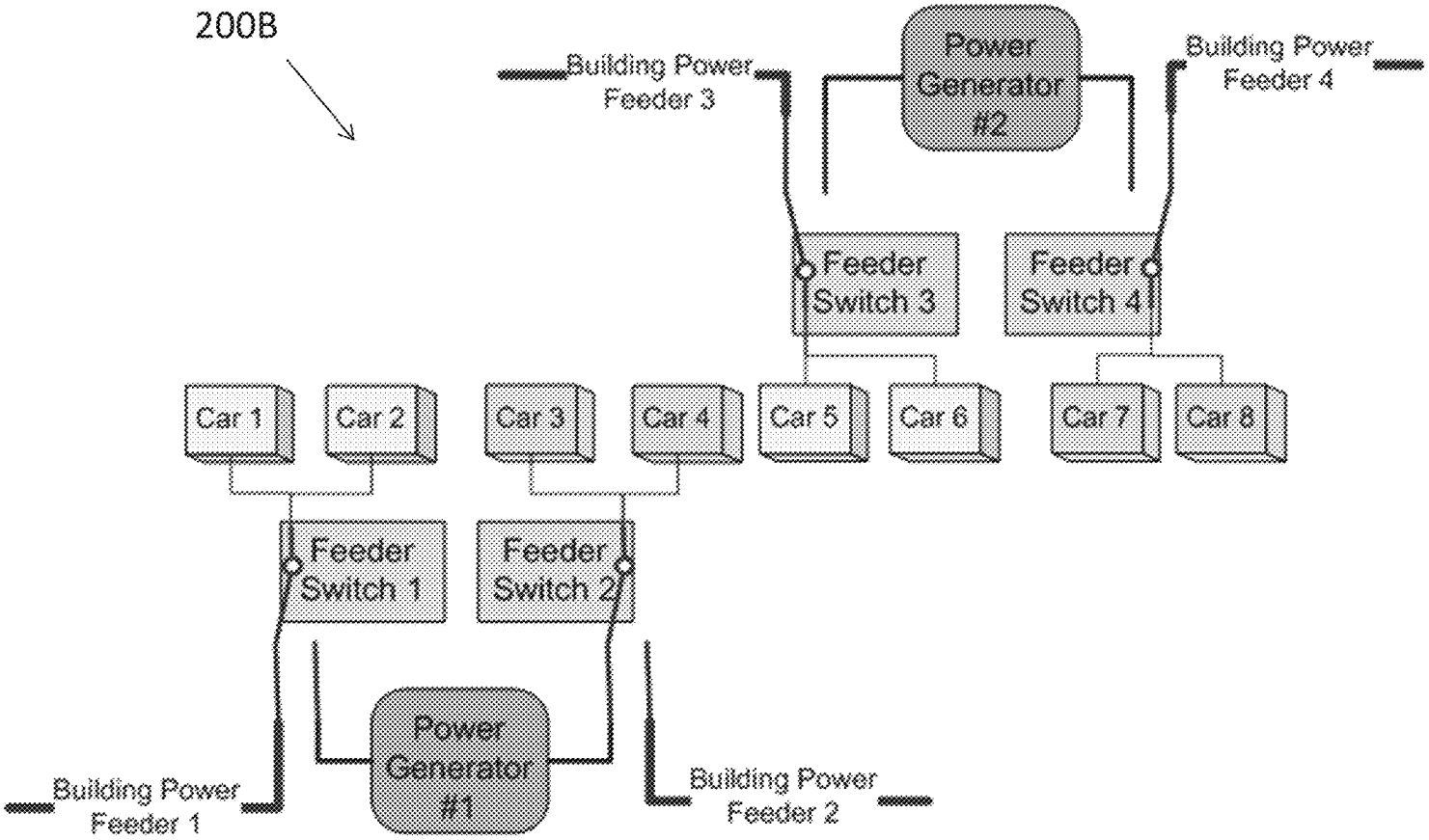
FIG. 2B depicts a system for balancing elevator car emergency power in an elevator system in accordance with one or more embodiments of the present disclosure.

FIG. 2B depicts a system 200B for balancing elevator car emergency power in an elevator system in accordance with one or more embodiments of the present disclosure. This embodiment is identical to FIG. 2A expect that it contains a duplicate of each element. Specifically, the system 200B has two back-up power sources that each provides emergency power to two separate feeder groups. The back-up power sources can be a generator, a solar panel, a wind turbine, a battery, an alternative feeder line, or any other known power means, and/or any combination thereof. As shown, the system 200B operates in a similar fashion such that at least one elevator car is selected from each feeder group. By providing separate back-up power sources the system 200B may be able to power and run additional elevator cars in each feeder group. For example, a building manager may provide a priority list of elevator cars listing all elevator cars in the system 200B from highest priority to lowest priority. For example, one such priority list may look as follows, with highest priority listed first: Car 1, Car 8, Car 2, Car 7, Car 3, Car 6, Car 4, and Car 5. The system 200B will go through the priority list and first select one elevator car from each feeder group. Specifically, the system will select Car 1, Car 8, Car 3, and Car 6 initially. The system 200B will then power the cars using the back-up power source that is connected to that feeder group. For example, Car 1 and Car 3 will be powered by power generator #1 as shown in FIG. 2B. Further, Car 8 and Car 6 are powered by power generator #2 as shown. Further, if either of the back-up power sources has additional power sufficient to power an additional elevator car, the next elevator in the priority list can be selected and powered. For example, if power generator #1 has additional power Car 2 will be powered and run. Alternatively, if power generator #2 has additional power Car 7 will be powered and run.

Figure 3:
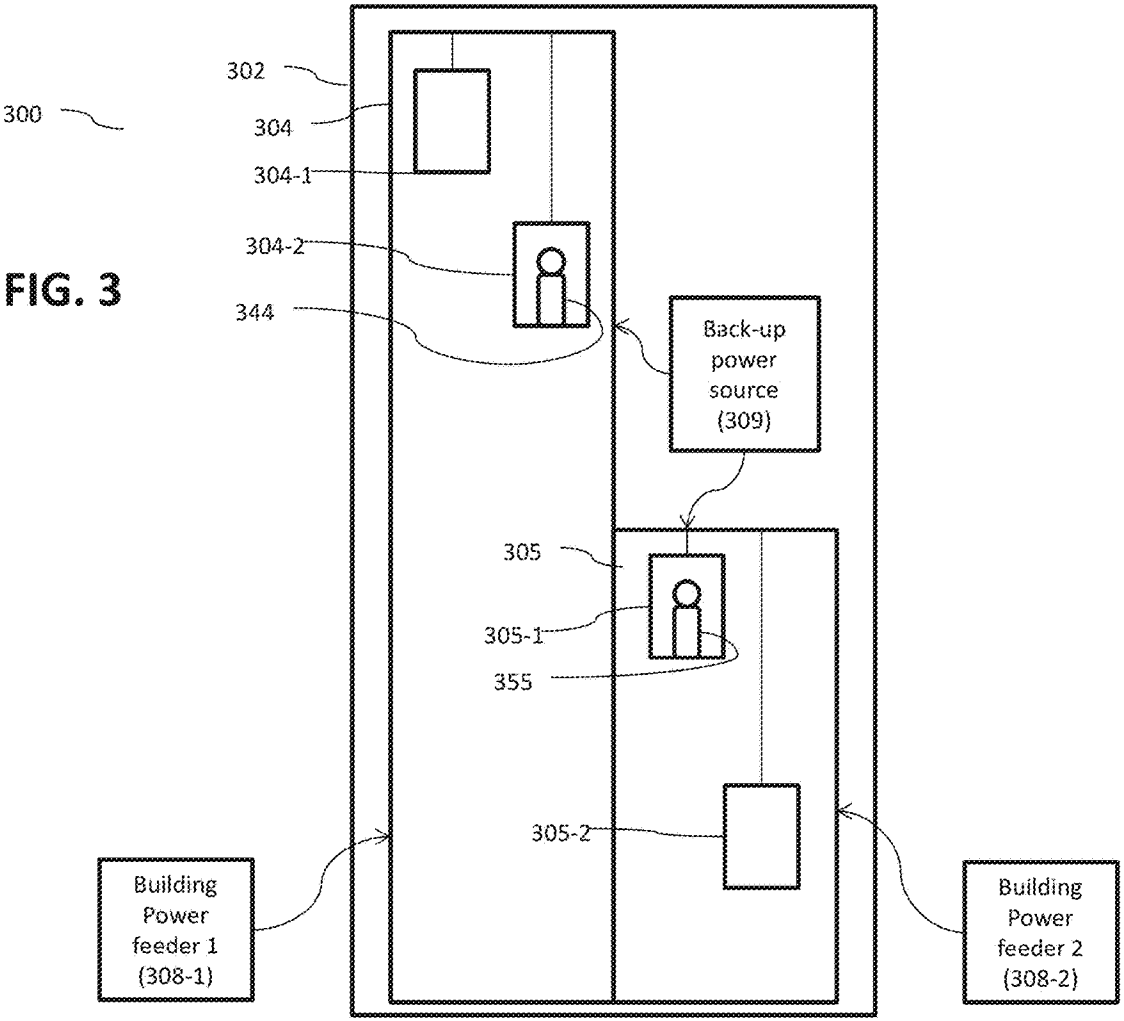
FIG. 3 depicts another system for balancing elevator car emergency power in an elevator system in accordance with one or more embodiments of the present disclosure.

FIG. 3 depicts another system 300 for balancing elevator car emergency power in an elevator system in accordance with one or more embodiments of the present disclosure. The system 300 is a building that includes similar elements to those shown in FIG. 2A. Specifically, the system 300 includes a feeder group 304 and a feeder group 305. As shown, and in accordance with one or more embodiments, the feeder group 304 can service higher floors within the building than the feeder group 305 can. Therefore, the feeder group 304 can be called a high-rise feeder group while the feeder group 305 can be called a low-rise feeder group. Further, as shown, and in accordance with one or more embodiments, the system 300 includes elevator cars 304-1, 304-2, 305-1, and 305-2. Further, the system 300 includes a back-up power source 309 that is connected to both feeder groups 304 and 305. The back-up power source 309 can be a generator, a solar panel, a wind turbine, a battery, an alternative feeder line, or any other known power means, and/or any combination thereof. Each feeder group 304 and 205 is connected to building power feeders 308-1 and 308-2, respectively. These building power feeders 308-1 and 308-2 provide building power to the feeder groups 304 and 305 during normal operating procedures. However, during an emergency, the building power feeders 308-1 an 308-2 may discontinue power services to the feeder groups 304 and 305. The system 300 may detect this action which will trigger the back-up power source 309 which can then commence providing power to the feeder groups 304 and 305. Each feeder group 304 and 305 will have at least one elevator car selected that will operate during the emergency condition. For example, as shown, feeder group 304 may operate elevator car 304-2 which will carry passengers 344 to safety. Similarly, feeder group 305 may operate elevator car 305-1 that will carry users 355 to safety.

Figure 4:
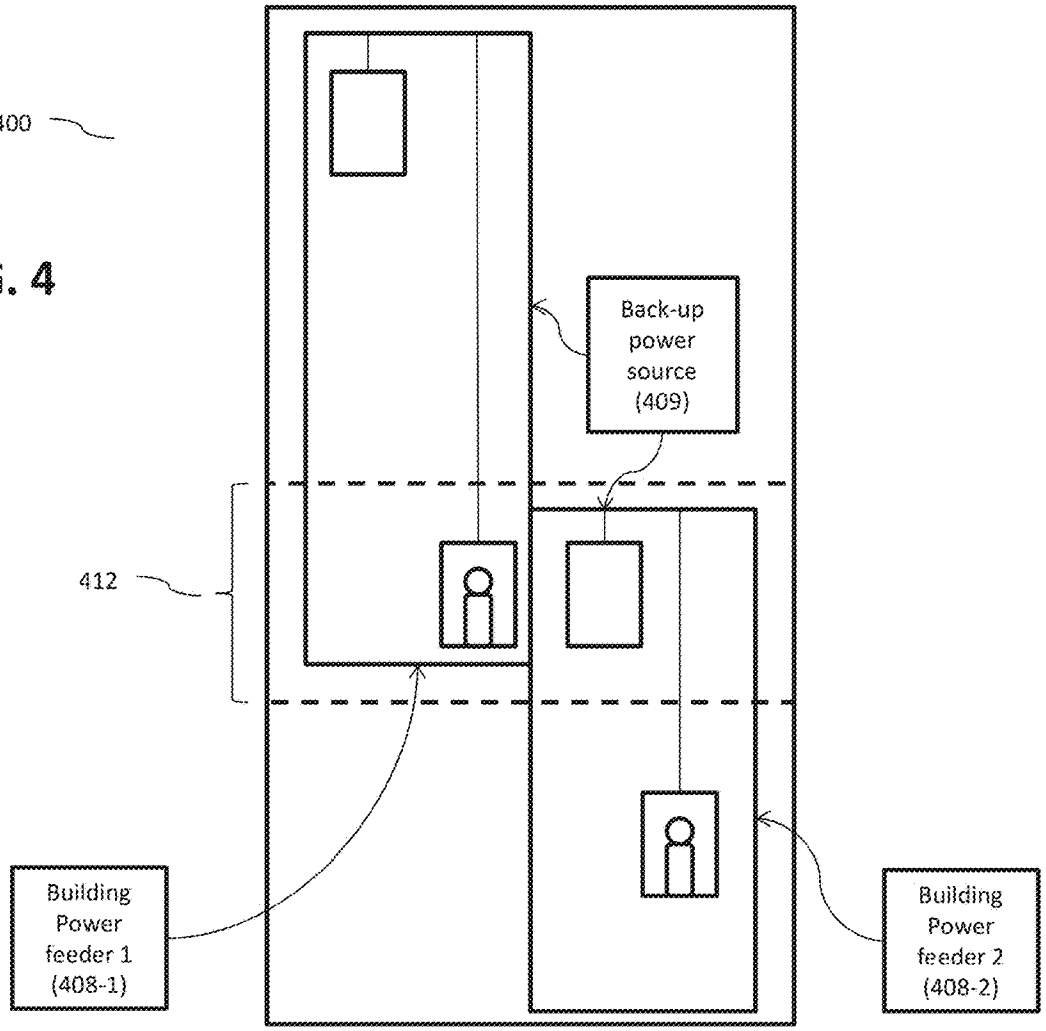
FIG. 4 depicts another system for balancing elevator car emergency power in an elevator system in accordance with one or more embodiments of the present disclosure.

FIG. 4 depicts another system 400 for balancing elevator car emergency power in an elevator system in accordance with one or more embodiments of the present disclosure. The elevator system 400 includes similar elements to those or FIG. 3. For example, the system 400 includes building power feeders 408-1 and 408-2 that power feeder groups that contain elevator cars. Further, the system includes a back-up power source 409 that powers at least one car from each feeder group during an emergency scenario that is selected by a controller which may be located anywhere in the system. The back-up power source 409 can be a generator, a solar panel, a wind turbine, a battery, an alternative feeder line, or any other known power means, and/or any combination thereof. As shown, and in accordance with one or more embodiments, the system 400 may include a sky bridge floor 412 were users will move from a first feeder group to a second feeder group when exiting the building. In this example the first feeder group does not reach the ground floor while the second feeder group does not reach upper floors. Other arrangements of what floors each feeder group service can also be including in accordance with one or more embodiments.

Figure 5:
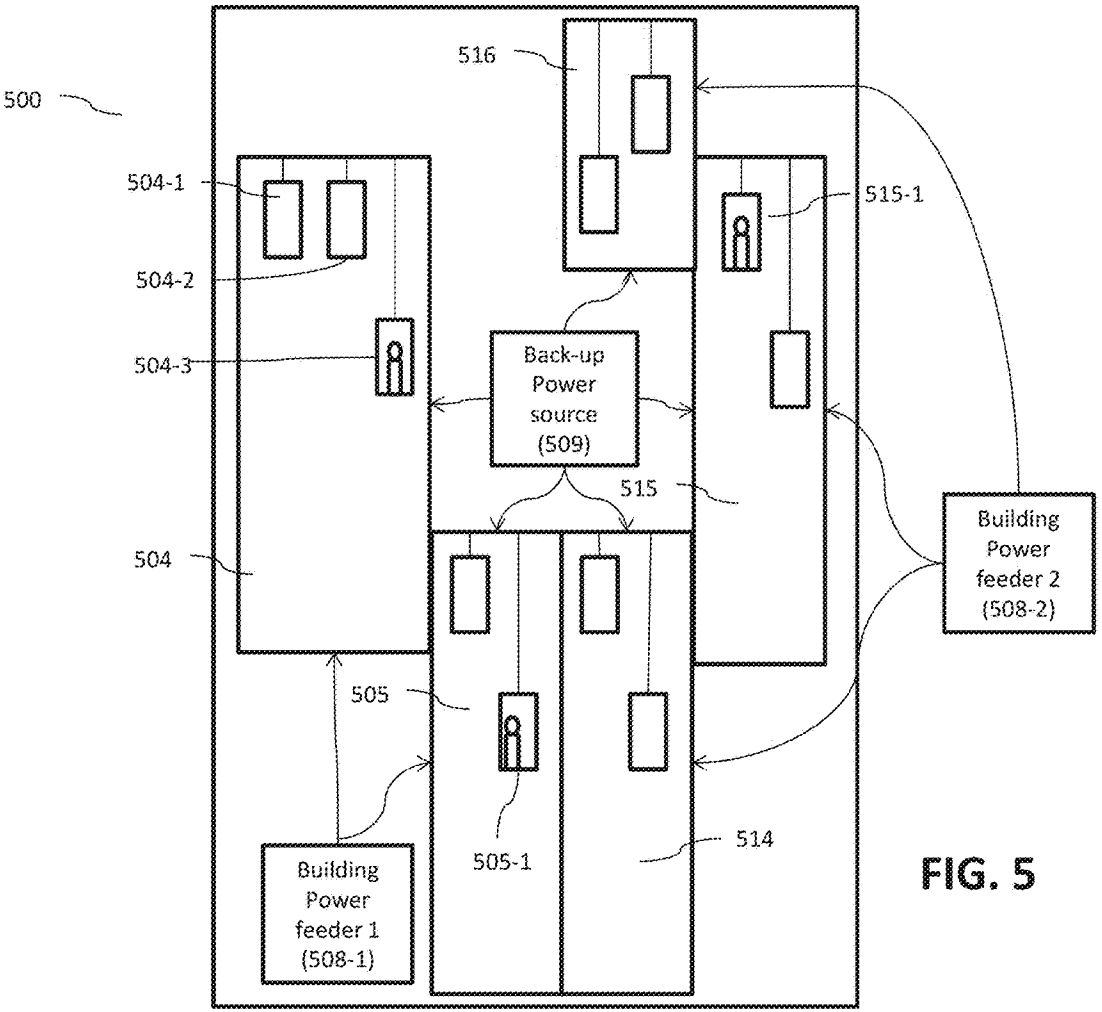
FIG. 5 depicts another system for balancing elevator car emergency power in an elevator system in accordance with one or more embodiments of the present disclosure.

FIG. 5 depicts another system 500 for balancing elevator car emergency power in an elevator system in accordance with one or more embodiments of the present disclosure. According to one or more embodiments, a plurality of elevator banks and hoist way arrangements may be included in feeder groups. For example, as shown, a first feeder group powered by feeder 508-1 may include elevator banks 504 and 505. A second feeder group powered by a feeder 508-2 may include elevators 514, 515, and 516. According to an embodiment, the elevators may include a plurality of elevator cars. For example, elevator 504 includes elevator cars 504-1, 504-2, and 504-3. Other elevators may include more or less elevator cars in accordance with one or more embodiments. Accordingly, as shown, a feeder group can include three or more elevator systems 514, 515, and 516 that each service different floors. Further, this example also provides that feeder groups do not need to be symmetrical in the number of elevator cars, elevators, and/or floors that are being serviced and powered. Thus, even when the feeder groups are asymmetrically distributed the back-up power source 509 is still connected and provides power to all the different elevators and feeder groups as shown. The back-up power source 509 can be a generator, a solar panel, a wind turbine, a battery, an alternative feeder line, or any other known power means, and/or any combination thereof. The differences in arrangement and power consumption are then taken into consideration when selecting what elevator cars to power using the limited power provided by the back-up power source 509.

Specifically, according to one embodiment, at least one elevator car is selected from each feeder group 508-1 and 508-2. For example, when the power source 509 is able to power elevator cars, a number of considerations and factors can be taken into account when selecting elevators to power during emergency conditions. For example, initially the power source 509 may power an elevator car 504-3 in the first feeder group 508-1 and an elevator car 515-1 from the second feeder group 508-2. Further, if the back-up power source 509 has additional power available to move another elevator, an elevator 505-1 may be selected for example. All of these selections can be made based on collected data that includes any number of values and factors such as collected sensor data, historical usage data, input data from a building manger, input data from one or more passengers, or other data provided in the system. The data can include anything from emergency type and location within building, location of passengers within building, power available from back-up power source, power consumption amount for different elevators based on expected loads, speed, operating condition, and time. For example, the data may include image data that indicates the location and number of passengers, image data that indicates the type and severity of the emergency, or any other detected value. Thus, the system is able to provide that at least one elevator car is operating in each feeder group. Further, the system can also provide that additional elevator cars can operate when additional power is available from the back-up power source. These additional elevator cars selected can be selected based on the same data and reasoning used to selected the initial elevator cars from each feeder group or can be selected based on different criteria and data.

According to one or more embodiments, the system and method can select an elevator car from each feeder group automatically. Specifically, the system controller can automatically make selection decisions without any input from a building owner or passenger including any preset input. For example, the system controller can know how much power each elevator car uses, where each of the elevator cars serve in the building, their frequency of use, the type, location, and severity of the emergency, etc. and can also be told the available power from the back-up power source. Based on one or more of these values the controller can select at least one elevator car in each feeder group automatically. Further, the system and method can include one or more sensors that collect data in and around the elevators that can be used to make the automatic selections. For example, image data that indicates the location and number of passengers, image data that indicates the type and severity of the emergency, weight values from weight plate sensors, wireless device signal strength and tracking values, or any other detectable value can be collected and used to make the automatic selection.

Figure 6:
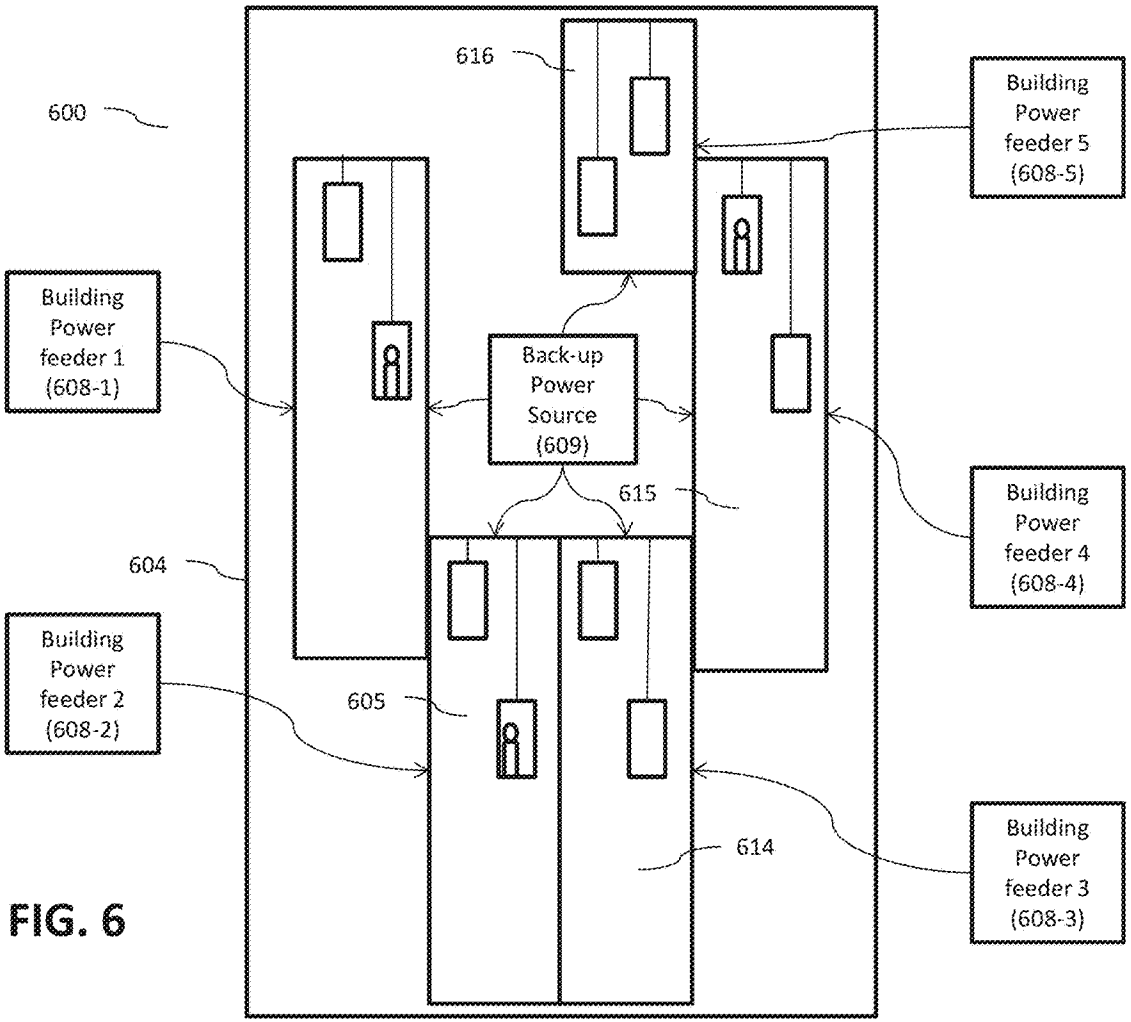
FIG. 6 depicts another system for balancing elevator car emergency power in an elevator system in accordance with one or more embodiments of the present disclosure.

FIG. 6 depicts another system 600 for balancing elevator car emergency power in an elevator system in accordance with one or more embodiments of the present disclosure. According to one embodiment, each elevator bank 604, 605, 614, 615, and 615 may be its own feeder group powered by its own feeder. For example, as shown, building power feeders 608-1, 608-2, 608-3, 608-4, and 608-5 each individually power an elevator bank 604, 605, 614, 615, and 615, respectively. Further, according to this embodiment all these elevators are still powered by a single back-up power source 609. The back-up power source 609 can be a generator, a solar panel, a wind turbine, a battery, an alternative feeder line, or any other known power means, and/or any combination thereof. Accordingly, a selection of one elevator car in each feeder group is implemented and then powered by the back-up power source 609. Thus, according to this embodiment, there can be a plurality of feeder groups that are connected together through a controller and the back-up power source 609. Specifically, as shown there are five feeder groups 608-1, 608-2, 608-3, 608-4, and 608-5 in this embodiment. According to one or more other embodiments, the number of feeder groups is scalable based on what is present in the building. For example, there may be as few as two feeder groups as described above with reference to FIGS. 1-5, three feeder groups, four feeder groups, five feeder groups as described in FIG. 6, or more depending on the size and complexity of the building and/or overall elevator system. The plurality of feeders is connected to the back-up power source 609 which powers at least one elevator car in each feeder group. Further, if the back-up power source 609 has additional power remaining, the back-up power source 609 can power additional elevator cars as discussed above.

Figure 7:
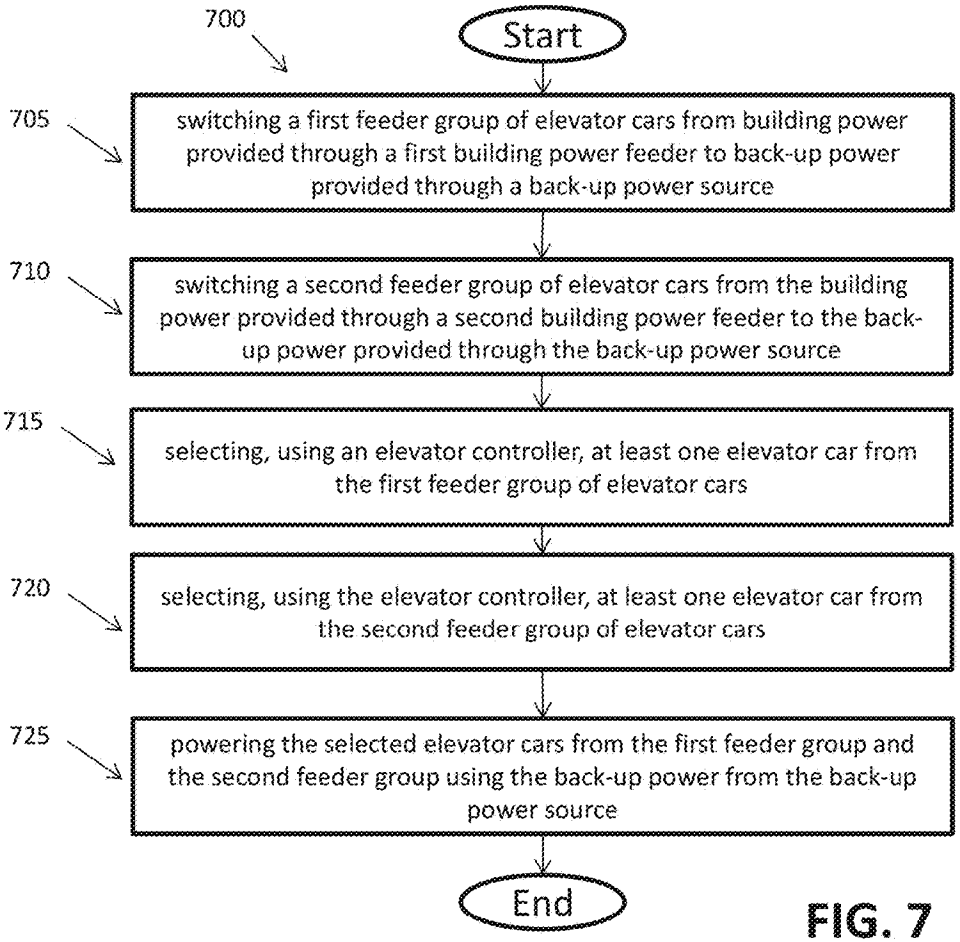
FIG. 7 depicts a flow diagram of a method of balancing elevator car emergency power in an elevator system in accordance with one or more embodiments of the present disclosure.

FIG. 7 depicts a flow diagram of a method 700 of balancing elevator car emergency power in an elevator system in accordance with one or more embodiments of the present disclosure. The method 700 includes switching a first feeder group of elevator cars from building power provided through a first building power feeder to back-up power provided through a back-up power source (operation 705). The method 700 also includes switching a second feeder group of elevator cars from the building power provided through a second building power feeder to the back-up power provided through the back-up power source (operation 710). Further, the method 700 includes selecting, using an elevator controller, at least one elevator car from the first feeder group of elevator cars (operation 715), and selecting, using the elevator controller, at least one elevator car from the second feeder group of elevator cars(operation 720). Finally, the method 700 includes powering the selected elevator cars from the first feeder group and the second feeder group using the back-up power from the back-up power source (operation 725).

In one embodiment, selection of the elevator cars from the first feeder group and the second feeder group is done based on a priority list provided by a building manager/owner. Specifically, the building manager will generate and provide a priority list of all elevator cars in the system included in both feeder groups. Then, the method will select an elevator car from each feeder group in the order they are provided in the priority list.

For example, looking at FIG. 5 the building manager can provide a priority list that has the elevator cars in the following order, with the highest priority elevator car listed first: 504-1, 505-1, 504-2, 504-3, and 515-1. From this list the method will go through and first select one elevator car from each feeder group. Accordingly, the method will select elevator car 504-1 from the first feeder group, elevator car 515-1 from the second feeder group. Further, if the back-up power source 509 has additional power sufficient to move an additional elevator car, the method can further select the next elevator car from the priority list that is not already running. Specifically, the method will select elevator car 505-1.

According to one or more embodiments, the selection of an elevator car can be made based on collected data that can include any number of value and factors such as collected sensor data, historical usage data, input data from a building manger, input data from one or more passengers, or other data provided in the system. The data can include anything from emergency type and location within building, location of passengers within building, power available from back-up power source, power consumption amount for different elevators based on expected loads, speed, operating condition, and time. For example, the data may include image data that indicates the location and number of passengers, image data that indicates the type and severity of the emergency, or any other detected value.

According to one or more embodiments, selecting, using the elevator controller, the at least one elevator car from the first feeder group of elevator cars, further includes selecting the at least one elevator car from the first feeder group of elevator cars based on one or more heuristics. According to another embodiment, selecting, using the elevator controller, the at least one elevator car from the second feeder group of elevator cars, further includes selecting the at least one elevator car from the second feeder group of elevator cars based on one or more heuristics.

According to one or more embodiments, the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

According to one or more embodiments, switching the first feeder group of elevator cars further includes switching a first feeder switch from a first position that connects the first feeder group of elevator cars to the first building power feeder to a second position that connects the first feeder group of elevator cars to the back-up power source.

According to one or more embodiments, switching the first feeder group of elevator cars further includes detecting an emergency condition, discontinuing the use of the building power by disconnecting from the first building power feeder in response to detecting the emergency condition, and commencing the use of the back-up power by connecting to the back-up power source in response to detecting the emergency condition.

According to one or more embodiments, the emergency condition is one selected from a group consisting of the building power from the first power feeder dropping below an operating threshold, a detection of a dangerous emergency condition within proximity of one or more elevators in the first feeder group, and a building management command noting the dangerous emergency condition.

According to one or more embodiments, switching the second feeder group of elevator cars further includes switching a second feeder switch from a first position that connects the second feeder group of elevator cars to the second building power feeder to a second position that connects the second feeder group of elevator cars to the back-up power source.

According to one or more embodiments, switching the second feeder group of elevator cars further includes detecting an emergency condition, discontinuing the use of the building power by disconnecting from the second building power feeder in response to detecting the emergency condition, and commencing the use of the back-up power by connecting to the back-up power source in response to detecting the emergency condition.

According to one or more embodiments, the first feeder group is a high rise elevator group, and wherein the second feeder group is a low rise elevator group.

According to one or more embodiments, the system and method further includes a plurality of feeder groups, wherein each of the plurality of feeder groups is switched from building power to the back-up power. Further, at least one elevator car is selected and powered from each feeder group in the plurality of feeder groups.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description has been presented for purposes of illustration and description, but is not intended to be exhaustive or limited to the embodiments in the form disclosed. Many modifications and variations will be apparent to those of ordinary skill in the art without departing from the scope of the disclosure. The embodiments were chosen and described in order to best explain the principles of the disclosure and the practical application, and to enable others of ordinary skill in the art to understand various embodiments with various modifications as are suited to the particular use contemplated.

The present embodiments may be a system, a method, and/or a computer program product at any possible technical detail level of integration. The computer program product may include a computer readable storage medium (or media) having computer readable program instructions thereon for causing a processor to carry out aspects of the present disclosure.

The computer readable program instructions may execute entirely on the user's mobile device, partly on the user's mobile device, as a stand-alone software package, partly on the user's mobile device and partly on a remote computer or entirely on the remote computer or server. In the latter scenario, the remote computer may be connected to the user's mobile device through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Accordingly, the present disclosure is not to be seen as limited by the foregoing description, but is only limited by the scope of the appended claims.

What is claimed is:

1. A method of balancing elevator car emergency power in an elevator system, the method comprising:

switching a first feeder group of elevator cars from building power provided through a first building power feeder to back-up power provided through a back-up power source;

switching a second feeder group of elevator cars from the building power provided through a second building power feeder to the back-up power provided through the back-up power source;

selecting, using an elevator controller, at least one elevator car from the first feeder group of elevator cars;

selecting, using the elevator controller, at least one elevator car from the second feeder group of elevator cars; and powering the selected elevator cars from the first feeder group and the second feeder group using the back-up power from the back-up power source.

2. The method of claim 1, wherein selecting, using the elevator controller, the at least one elevator car from the first feeder group of elevator cars, further comprises:

selecting the at least one elevator car from the first feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

3. The method of claim 1, wherein selecting, using the elevator controller, the at least one elevator car from the second feeder group of elevator cars, further comprises:

selecting the at least one elevator car from the second feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

4. The method of claim 1, wherein switching the first feeder group of elevator cars further comprises:

switching a first feeder switch from a first position that connects the first feeder group of elevator cars to the first building power feeder to a second position that connects the first feeder group of elevator cars to the back-up power source.

5. The method of claim 1, wherein switching the first feeder group of elevator cars further comprises:

detecting an emergency condition;

discontinuing the use of the building power by disconnecting from the first building power feeder in response to detecting the emergency condition; and commencing the use of the back-up power by connecting to the back-up power source in response to detecting the emergency condition.

6. The method of claim 5, wherein the emergency condition is one selected from a group consisting of the building power from the first power feeder dropping below an operating threshold, a detection of a dangerous emergency condition within proximity of one or more elevators in the first feeder group, and a building management command noting the dangerous emergency condition.

7. The method of claim 1, wherein switching the second feeder group of elevator cars further comprises:

switching a second feeder switch from a first position that connects the second feeder group of elevator cars to the second building power feeder to a second position that connects the second feeder group of elevator cars to the back-up power source.

8. The method of claim 1, wherein switching the second feeder group of elevator cars further comprises:

detecting an emergency condition;

discontinuing the use of the building power by disconnecting from the second building power feeder in response to detecting the emergency condition; and commencing the use of the back-up power by connecting to the back-up power source in response to detecting the emergency condition.

9. The method of claim 8, wherein the emergency condition is one selected from a group consisting of the building power from the second power feeder dropping below an operating threshold, a detection of a dangerous emergency condition within proximity of one or more elevators in the second feeder group, and a building management command noting the dangerous emergency condition.

10. The method of claim 1, wherein selecting at least one elevator car from the first feeder group of elevator cars is done automatically based on collected data, and wherein selecting at least one elevator car from the second feeder group of elevator cars is done automatically based on collected data.

11. The method of claim 1, further comprising:

a plurality of feeder groups, wherein each of the plurality of feeder groups is switched from building power to the back-up power, and wherein, using the elevator controller, at least one elevator car is selected and powered from each feeder group in the plurality of feeder groups.

12. A system for balancing elevator car emergency power, the system comprising:

a first feeder group of elevator cars configured to switch from building power provided through a first building power feeder to back-up power provided through a back-up power source;

a second feeder group of elevator cars configured to switch from the building power provided through a second building power feeder to the back-up power provided through the back-up power source; and an elevator controller that selects at least one elevator car from the first feeder group of elevator cars and selects at least one elevator car from the second feeder group of elevator cars, wherein the back-up power source powers the selected elevator cars from the first feeder group and the second feeder group using the back-up power.

13. The system of claim 12, wherein the first feeder group of elevator cars further comprises:

a first feeder switch configured to switch from a first position that connects the first feeder group of elevator cars to the first building power feeder to a second position that connects the first feeder group of elevator cars to the back-up power source.

14. The system of claim 12, wherein the second feeder group of elevator cars further comprises:

a second feeder switch configured to switch from a first position that connects the second feeder group of elevator cars to the second building power feeder to a second position that connects the second feeder group of elevator cars to the back-up power source.

15. The system of claim 12, wherein selecting at least one elevator car from the first feeder group of elevator cars is done automatically based on collected data, and wherein selecting at least one elevator car from the second feeder group of elevator cars is done automatically based on collected data.

16. The system of claim 12, further comprising:

a plurality of feeder groups, wherein each of the plurality of feeder groups is switched from building power to the back-up power, and wherein, using the elevator controller, at least one elevator car is selected and powered from each feeder group in the plurality of feeder groups.

17. A computer program product for balancing elevator car emergency power, the computer program product comprising a computer readable storage medium having program instructions embodied therewith, the program instructions executable by a processor to cause the processor to:

switch a first feeder group of elevator cars from building power provided through a first building power feeder to back-up power provided through a back-up power source;

switch a second feeder group of elevator cars from the building power provided through a second building power feeder to the back-up power provided through the back-up power source;

select, using an elevator controller, at least one elevator car from the first feeder group of elevator cars;

select, using the elevator controller, at least one elevator car from the second feeder group of elevator cars; and power the selected elevator cars from the first feeder group and the second feeder group using the back-up power from the back-up power source.

18. The computer program product of claim 17, the computer program product comprising additional program instructions executable by the processor to cause the processor to:

select the at least one elevator car from the first feeder group of elevator cars based on one or more heuristics; and select the at least one elevator car from the second feeder group of elevator cars based on one or more heuristics, wherein the one or more heuristics includes selection based on elevator car with largest capacity, elevator car furthest from emergency condition, elevator car that can service the most floors, elevator nearest evacuating passengers, elevator power consumption, elevator safety rating, feeder group elevator car priority list, and most popular elevator car in feeder group.

19. The computer program product of claim 17, the computer program product comprising additional program instructions executable by the processor to cause the processor to:

switch a first feeder switch from a first position that connects the first feeder group of elevator cars to the first building power feeder to a second position that connects the first feeder group of elevator cars to the back-up power source; and switch a second feeder switch from a first position that connects the second feeder group of elevator cars to the second building power feeder to a second position that connects the second feeder group of elevator cars to the back-up power source.

20. The computer program product of claim 17, the computer program product comprising additional program instructions executable by the processor to cause the processor to:

detect an emergency condition;

discontinue the use of the building power by disconnecting from the first building power feeder in response to detecting the emergency condition;

discontinue the use of the building power by disconnecting from the second building power feeder in response to detecting the emergency condition; and commence the use of the back-up power by connecting to the back-up power source in response to detecting the emergency condition.

* * * * *